US009888741B2

(12) United States Patent
Diard et al.

(10) Patent No.: US 9,888,741 B2
(45) **Date of Patent: *Feb. 13, 2018**

(54) FOR A SHOE, IN PARTICULAR FOR A SPORTS SHOE

(71) Applicant: DECKERS OUTDOOR CORPORATION, Goleta, CA (US)

(72) Inventors: Jean-Luc Diard, Annecy (FR); Nicolas Mermoud, Annecy le Vieux (FR)

(73) Assignee: DECKERS OUTDOOR CORPORATION, Goleta, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/199,000

(22) Filed: Jun. 30, 2016

(65) Prior Publication Data

US 2016/0309841 A1 Oct. 27, 2016

Related U.S. Application Data

(63) Continuation of application No. 14/495,298, filed on Sep. 24, 2014, now Pat. No. 9,439,473, which is a (Continued)

(30) Foreign Application Priority Data

May 27, 2009 (FR) ..... 09 53509
Jun. 30, 2009 (FR) ..... 09 54456

(51) Int. Cl.
*A43B 13/14* (2006.01)
*A43B 3/00* (2006.01)
(Continued)

(52) U.S. Cl.
CPC ..... *A43B 13/145* (2013.01); *A43B 3/0036* (2013.01); *A43B 5/00* (2013.01);
(Continued)

(58) Field of Classification Search
CPC ..... A43B 3/00; A43B 3/0036; A43B 13/00; A43B 13/14; A43B 13/143; A43B 13/145; A43B 13/146
(Continued)

(56) References Cited

U.S. PATENT DOCUMENTS 4,425,721 A 1/1984 Spronken
5,092,060 A 3/1992 Frachey et al.
(Continued)

FOREIGN PATENT DOCUMENTS

CN 1047439 A 12/1990
CN 2244314 Y 1/1997
(Continued)

OTHER PUBLICATIONS

Japanese Office Action in Japanese Patent Application No. 2012-512469 dated May 20, 2014.
(Continued)

*Primary Examiner* — Marie Bays
(74) *Attorney, Agent, or Firm* — Greer, Burns & Crain, Ltd.

(57) ABSTRACT

A shoe including a sole having specific characteristics, namely a width, a length, a thickness and a front/rear profile, where the sole is made with materials having a certain type of deformation and lateral reinforcements emerging from the sole and surrounding the upper that are suitable for significantly increasing both performance, such as speed and reduced fatigue, and user comfort, such as reduced impact on knees, back, leg muscles, of the shoe, which are particularly suited for use when jogging or walking on uneven outdoor surfaces, as well as for jogging or walking on roads. Furthermore, the characteristics of the sole, such as the spike surface and deformation when contacting the ground,
(Continued)

improve safety for a user by providing enhanced grip on sloping terrain as well as on snow-covered or wet terrain.

10 Claims, 2 Drawing Sheets

Related U.S. Application Data continuation of application No. 13/322,389, filed as application No. PCT/IB2010/001289 on May 27, 2010, now Pat. No. 8,881,427.

(51) Int. Cl.

| | |
|---|---|
| ***A43B 5/00*** | (2006.01) |
| ***A43B 13/18*** | (2006.01) |
| ***A43B 13/04*** | (2006.01) |
| ***A43B 5/06*** | (2006.01) |
| ***A43B 13/32*** | (2006.01) |

(52) U.S. Cl.
CPC ..... *A43B 5/002* (2013.01); *A43B 5/06* (2013.01); *A43B 13/04* (2013.01); *A43B 13/143* (2013.01); *A43B 13/187* (2013.01); *A43B 13/32* (2013.01)

(58) Field of Classification Search
USPC ..... 36/25 R, 88, 31, 142–144
See application file for complete search history.

(56) References Cited

U.S. PATENT DOCUMENTS

| | | | | |
|---|---|---|---|---|
| 5,491,909 | A | 2/1996 | Darby | |
| 6,519,878 | B2 | 2/2003 | Yoshiaki | |
| 7,231,728 | B2 | 6/2007 | Darby | |
| 7,234,251 | B2 | 6/2007 | Fuerst et al. | |
| 7,793,437 | B2 | 9/2010 | Chapman et al. | |
| 8,881,427 | B2 * | 11/2014 | Diard | A43B 5/002 36/25 R |
| 9,439,473 | B2 * | 9/2016 | Diard | A43B 5/002 |
| 2002/0157279 | A1 | 10/2002 | Matsuura et al. | |
| 2002/0178621 | A1 | 12/2002 | Darby | |
| 2003/0172548 | A1 | 9/2003 | Fuerst | |
| 2004/0261296 | A1 | 12/2004 | Bhunachet | |
| 2005/0160625 | A1 | 7/2005 | Whatley | |
| 2007/0209230 | A1 | 9/2007 | Dillon | |
| 2008/0163513 | A1 | 7/2008 | Chapman et al. | |
| 2008/0263900 | A1 | 10/2008 | Determe et al. | |
| 2009/0282700 | A1 | 11/2009 | Dillon | |
| 2010/0307032 | A1 | 12/2010 | Geer et al. | |
| 2011/0067267 | A1 | 3/2011 | Lubart | |
| 2011/0072690 | A1 | 3/2011 | Teteriatnikov et al. | |
| 2011/0113646 | A1 | 5/2011 | Merritt et al. | |

FOREIGN PATENT DOCUMENTS

| | | |
|---|---|---|
| CN | 1350814 A | 5/2002 |
| EP | 1839511 | 10/2007 |
| JP | 2006204712 | 8/2006 |
| WO | 1998031245 | 7/1998 |
| WO | 2007074978 | 7/2007 |

OTHER PUBLICATIONS

"Creepers" web page, URL:http://fr.wikipedia.org/wiki/Creepers, published Sep. 17, 2012 .

"Rayanne Double Sole Brothel Creepers" web page, URL:http://www.underground-cybershop.co.ukdouble-sole-wulfrun-creepers-black-suede, published Jul. 19, 2012.

* cited by examiner

FOR A SHOE, IN PARTICULAR FOR A SPORTS SHOE

PRIORITY CLAIM

This application is a continuation of and claims priority to U.S. patent application Ser. No. 14/495,298 filed on Sep. 24, 2014, which claims priority to U.S. patent application Ser. No. 13/322,389 filed on Mar. 6, 2012, which claims priority to PCT Application No. PCT/IB2010/001289 filed on May 27, 2010, which claims priority to French Patent Application No. 0954456 filed on Jun. 30, 2009 and French Patent Application No. 0953509 filed on May 27, 2009, the entire contents of which are incorporated herein by reference.

The present invention relates to an improvement for shoes especially for athletic shoes designed to comfortably navigate very irregular terrain, such as for example that found in mountains, particularly descents with rocks, roots or the like.

In known manner, the shoes feature an upper mounted on an outer sole, and one finds in the market a large selection of athletic shoes, so that the user can choose the type of footwear suitable for the intended purpose.

However good, the sophisticated athletic shoes present a number of disadvantages that the shoe of the invention intends to eliminate.

Thanks to the shoe according to the invention and in particular thanks to the geometry of the lower face of the sole, as well as thanks to the volume and nature of this sole, the movement of the foot takes place naturally, and this regardless of the type of terrain, whether uphill, downhill or on flat ground. In fact, thanks to the sole there is continuity of contact and progressively unrolling.

On reading the following description, it will be understood that the benefits mentioned above exist while respecting the natural position of the foot.

One also understands that thanks to its sole, the shoe of the invention performs particularly well in uneven terrain.

We add that thanks to the side edge, the sole achieves excellent lateral stability, protecting also from shocks.

Other features and advantages of the invention will be apparent from the description which follows, in viewing the accompanying drawings which are given as non-limiting examples.

DETAILED DESCRIPTION

Figure 1:
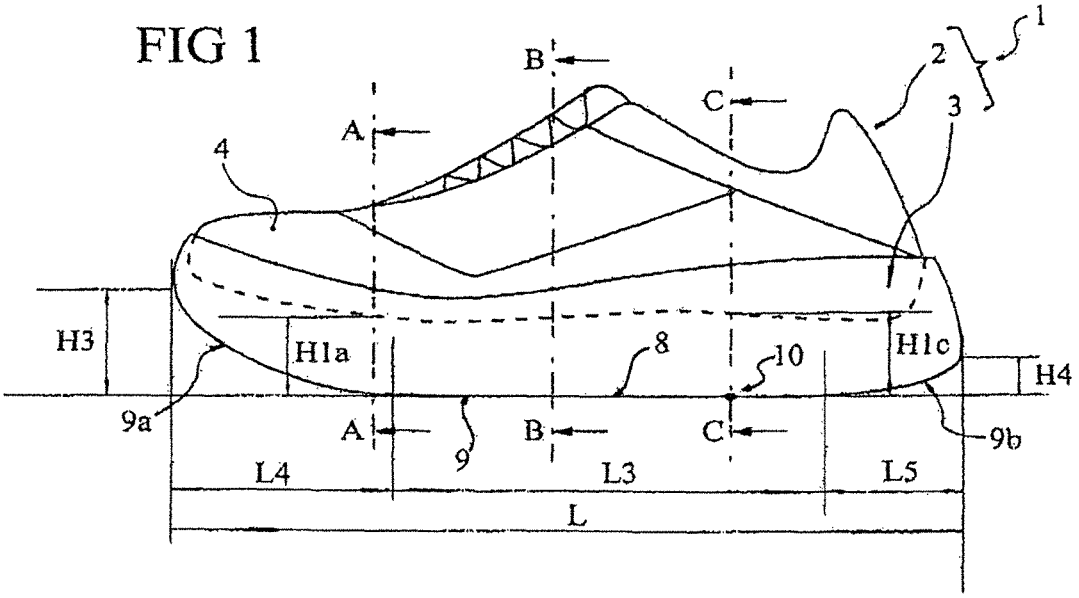
FIG. 1 is a side view of the shoe of the invention.
Figure 2:
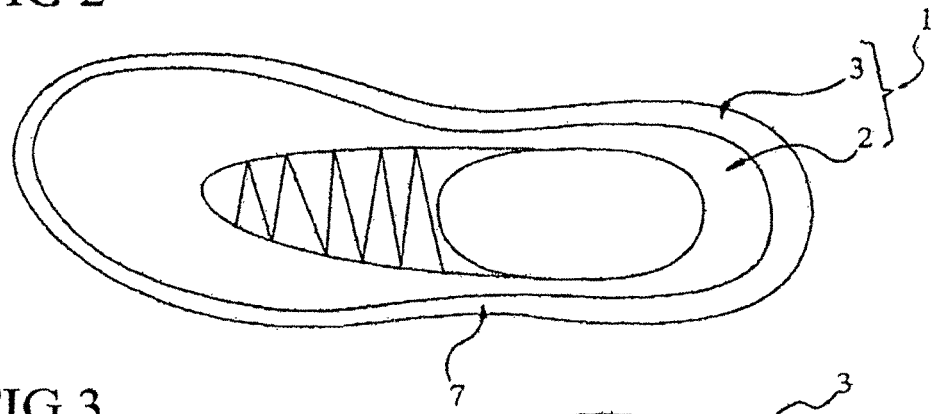
FIG. 2 is a top view.
Figure 3:
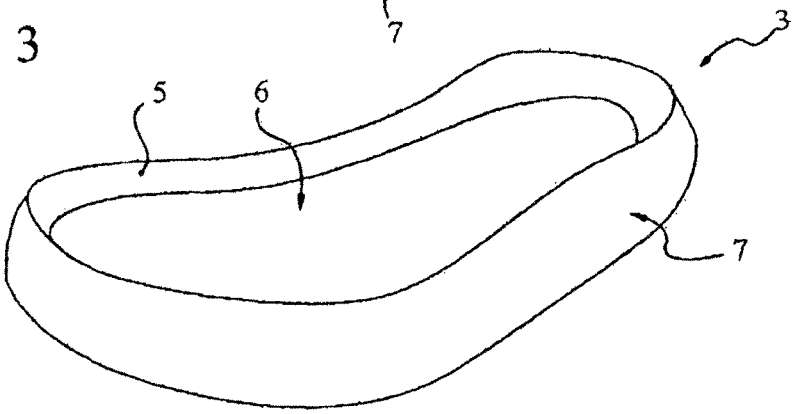
FIG. 3 shows the sole in a perspective view.

The shoe of the invention bearing the general reference 1 comprises in a known manner an upper 2 mounted on an outer sole 3.

The upper is constituted by a shoe box 4 in which the foot of the user is retained. Thus, this upper which is made for example with a flexible material has substantially the shape of the foot of the user, and includes retaining means such as for example a lace.

According to one characteristic, the upper 2 is mounted on the outer sole 3 for it to be secured to its lower part. The upper is of course secured to its sole by any suitable means known such as gluing and the like and is retained by its lower part by a peripheral rim 5 made up of a wall extending upwards surrounding therefore the lower part of the upper. In other words, the sole comprises a central basin 6 constituted by a hollow contour open towards the top for receiving the upper, said hollow being formed by the peripheral rim.

Note that at the level of joining with the sole, the upper cross-section presents widths L1 according to these same cross-sections, the width of the sole at the level that is supported on the ground has widths L2 greater than the width L1 of the upper.

Thus, according to one characteristic of the shoe of the invention the ratio between the value of the width L2 of the sole at the level that is supported on the ground relative to the width L1 is a coefficient K1 between 1.5 and 1.8.

Furthermore, the sole has a thickness H1 comprised between 20 mm and 55 mm while the height H2 for receiving the upper in the sole is between 20 and 30 mm.

Figure 4A:
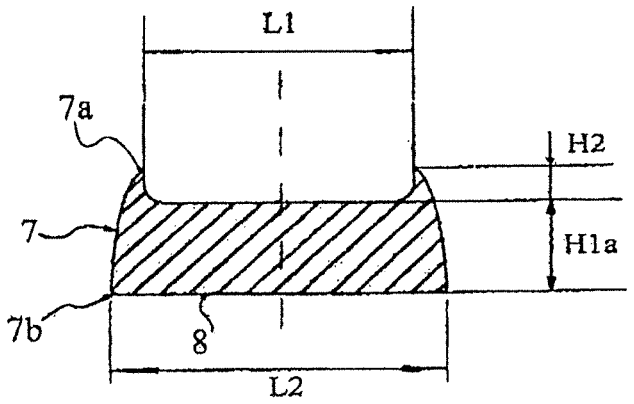
FIGS. 4A, 4B, 4C are views according to transverse cross-sections A-A, B-B, C-C, respectively.
Figure 4B:
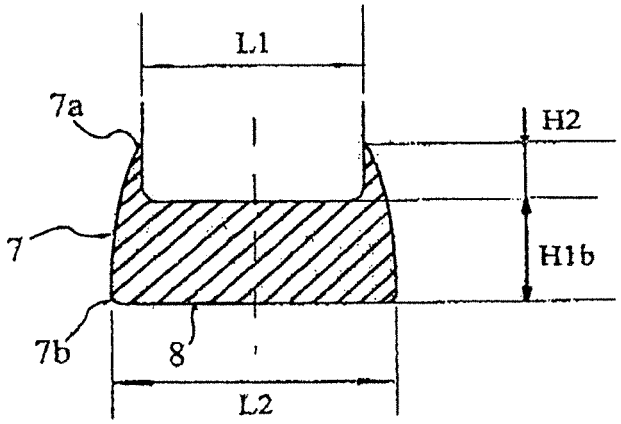
Figure 4C:
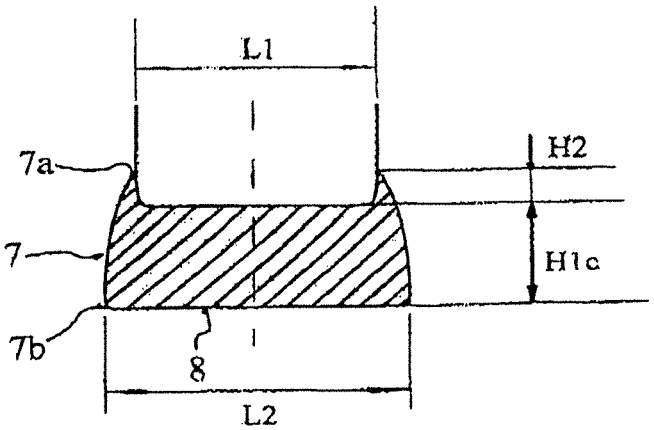

In addition, we note that according to an additional characteristic the side wall 7 of the sole is curved to reach the high point 7*a* from the low point 7*b* as can be seen in FIGS. 4A, 4B, 4C.

Additionally, the lower surface 8 of the sole comprises a substantially flat central portion 9 extended at the front by a curved raised front portion 9*a*, and to the rear by a curved raised rear portion 9*b*.

Note that the central portion 9 extends over a length L3 whose value is between 40 and 70% of the value of the total length L of the sole.

Know that the length L4 of the curved raised front portion 9*a* has a value between 25 and 40% of the value of the total length L of the sole, while the length L5 of the curved raised rear portion 9*b* has a value between 15 and 30% of the value of the total length L of the sole 3.

Also note that the height H3 which the curved raised front portion 9*a* is raised has a value between 30 and 40% of the length L4 of this same raised front portion 9*a*.

Moreover, one will note that the substantially flat central portion 9 extends in part rearward of the point of support 10 of the heel and in part forward from this point, as far as the metatarsals.

One also notes that the height H4 which the raised rear portion 9*b* is raised has a value less than the value of the height H3 that the raised front portion 9*a* is raised.

Advantageously, the sole is made of material such as EVA (ethylene vinyl acetate copolymer) whose Shore "D" hardness is for example between 50 and 70.

In this regards the thickness of the sole, for a shoe of sole length L of about 300 mm, the latter is at the level of support of the heel H1*c* between 30 and 55 mm, and at the level of the forefoot H1*a* between 20 and 40 mm. This means that the height H1*a* is between 5 and 15% of the length L and that the height H1*c* is between 10 and 20% of the length L.

It is well understood that the invention is not limited to the embodiments described and shown as examples, but also includes all technical equivalents and combinations thereof.

What is claimed is:

1. A shoe which comprises: an upper mounted on a sole with a sole length; a thickness of the sole at the level of supporting a heel is between 10% and 20% of the sole length, a thickness of the sole at the level of a forefoot is between 5% and 15% of the sole length, said sole including central portion between the heel and the forefoot, said central portion having a bottom surface that is substantially flat.

2. The shoe according to claim 1, wherein the bottom surface of the substantially flat central portion of the sole extends to the front by a curved raised front portion and extends to the rear by a curved raised rear portion.

3. The shoe according to claim 2, wherein a length of the curved raised rear portion is between 15% and 30% of the sole length.

4. The shoe according to claim 3, wherein a height which the curved raised front portion is raised is between 30% and 40% of the length of said raised front portion.

5. The shoe according to claim 4, wherein a height which the rear portion is raised is less than the height that the raised front portion is raised.

6. A shoe which comprises: an upper mounted on a sole with a sole length; a thickness of the sole at the level of supporting a heel is between 10% and 20% of the sole length, a thickness of the sole at the level of a forefoot is between 5% and 15% of the sole length, said sole including a central portion having a bottom surface that is substantially flat, wherein the bottom surface of the substantially flat central portion of the sole extends to the front by a curved raised front portion and extends to the rear by a curved raised rear portion, and wherein a height of the rear portion is less than a height of the front portion.

7. The shoe according to claim 1, wherein a width of a bottom end of the sole at a level resting on the ground is greater than a width of an upper end of the sole.

8. The shoe according to claim 7, wherein a ratio of the width of the lower end to the width of the upper is between 1.5 to 1.8.

9. The shoe according to claim 6, wherein a width of a bottom end of the sole at a level resting on the ground is greater than a width of an upper end of the sole.

10. The shoe according to claim 9, wherein a ratio of the width of the lower end to the width of the upper is between 1.5 to 1.8.

* * * * *